United States Patent [19]

Yen

[11] 3,963,886

[45] June 15, 1976

[54] SWITCH FOR FLASHLIGHT

[76] Inventor: Ting Shen Yen, 40, Bedford Road, 7th Floor, Taikoktsui, Kowloon, Hong Kong

[22] Filed: Dec. 4, 1974

[21] Appl. No.: 529,278

[30] Foreign Application Priority Data

Sept. 10, 1974 United Kingdom ..... 39500/74

[52] U.S. Cl. ..... 200/60; 200/67 DB; 240/10.68

[51] Int. Cl.[2] ..... F21V 23/04; H01H 1/34

[58] Field of Search ..... 200/60, 67 DB, 339; 240/10.63, 10.66, 11.3, 25, 6.4 R, 10.5, 10.68

[56] References Cited

UNITED STATES PATENTS

| | | | |
|---|---|---|---|
| 2,234,972 | 3/1941 | Lennan | 200/60 X |
| 2,395,698 | 2/1946 | Tiffany | 200/67 DB |
| 2,755,352 | 7/1956 | Birkemeier | 200/67 DB |
| 2,930,886 | 3/1960 | Lennan | 200/60 X |
| 3,133,170 | 5/1964 | Nanninga | 200/67 DB |
| 3,264,464 | 8/1966 | Gits | 200/60 X |
| 3,351,723 | 11/1967 | Ming et al. | 200/60 |

*Primary Examiner*—James R. Scott
*Attorney, Agent, or Firm*—Prutzman, Hayes, Kalb & Chilton

[57] ABSTRACT

An electric flashlight comprising a first circuit contact, a second circuit contact spaced from the first contact and a switch for selectively connecting and disconnecting the first and second contacts. The switch includes a casing having spaced ends and side walls with a leaf spring forming the switch contact strip pivoted intermediate its ends on the casing to form a first spring portion which is movable into and out of engagement with the first circuit contact and a second spring portion in permanent engagement with the second circuit contact. The spring is provided with spaced protuberances which engage, the inner surfaces of said casing end walls, the distance between the end walls being less than the distance between the protuberances which causes flexure of the spring. Actuating members are provided which selectively effect the movement of the first spring portion into and out of engagement with the first circuit contact.

8 Claims, 4 Drawing Figures

SWITCH FOR FLASHLIGHT

The present invention relates to a switch for electrical applicance, and more particularly, although not exclusively, to electric hand flashlights.

The object of the present invention is to provide a switch for an electrical appliance which can positively maintain the electrical circuit of the appliance in an energised, or de-energised, condition and inhibits accidental actuation of the circuit-forming members.

The present invention consists in a switch for an electrical appliance comprising a casing having spaced end and side walls, a leaf spring forming the switch contact strip pivoted intermediate its ends on the casing to form a first portion and a second portion, spaced protuberances on the spring which engage, the inner surfaces of the casing end walls, the distance between the end walls being less than the distance between the protuberances which causes flexure of the spring, and actuating members which, cause controlled flexure of the first and second portions of the spring to effect operation of the switch.

Figure 1:
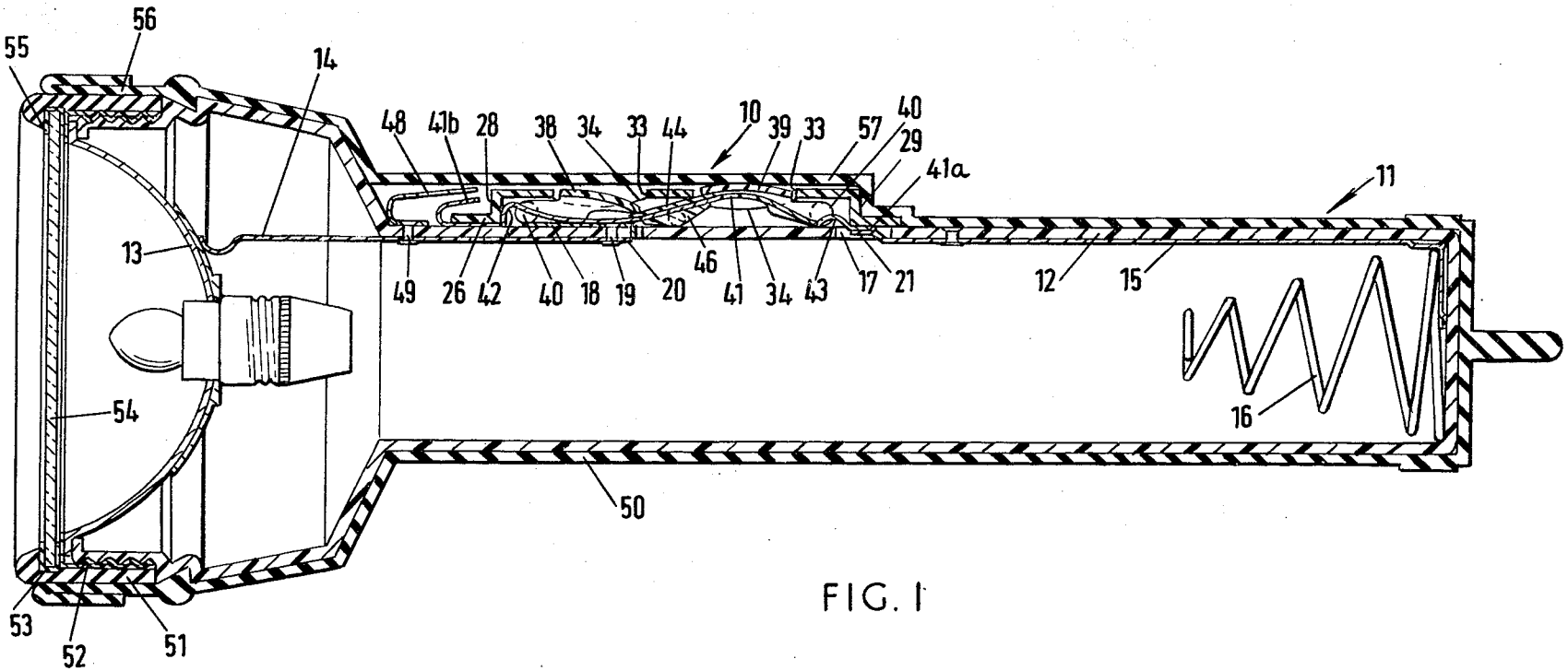
FIG. 1 is a cross-section through a hand-operated flashlight having a switch according to the present invention.
Figure 2:
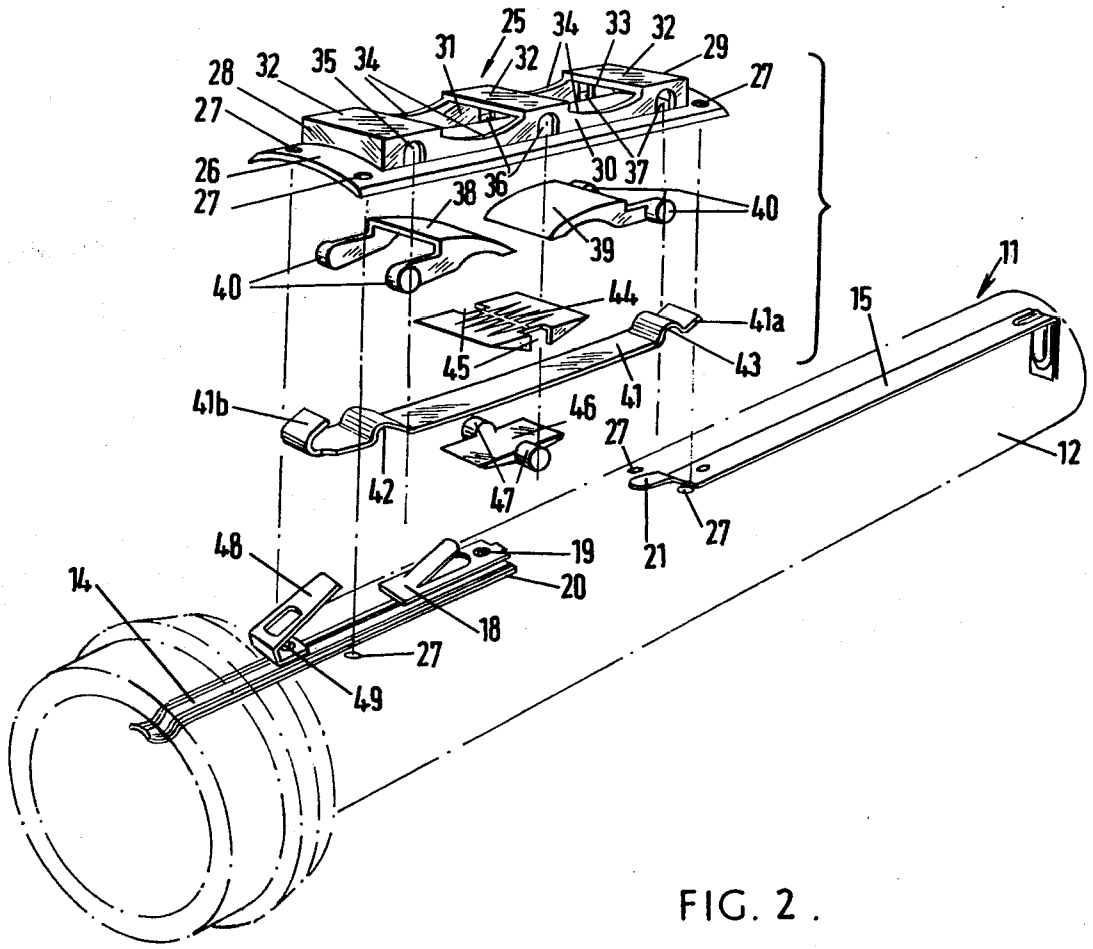
FIG. 2 is an exploded perspective view of the switch shown in FIG. 1 and electrical contacts mounted on the casing.

In carrying the invention into effect according to one convenient mode, by way of example, a switch 10 is mounted on a flashlight 11 as shown in FIGS. 1 and 2. The flashlight 11 comprises a molded plastic casing 12 housing a bulb and reflector assembly 13 and two longitudinally-extending contact strips 14 and 15 positioned in alignment with each other along the inside of the casing 12 and connected, respectively, to the reflector assembly 13 and a battery spring 16 in known manner. Forward contact 20 and rear contact 21 of the reflector contact strip 14 and battery spring contact strip 15, respectively, are spaced from one another with the rear contact 21 positioned in an aperture 17 formed in the casing 12 and the front contact 20 connected to an auxiliary contact 18 by a rivet 19 extending through the casing 12, the auxiliary contact 18 forming part of the forward contact 20.

The switch 10 comprises an open-bottomed casing 25 formed of plastics material and having a peripheral flange 26 which is mounted on the casing 12, over the forward and rear contacts 20, 21 respectively, by means of rivets passing through aligned apertures 27 in the flange 26 and casing 12, respectively. Spaced end walls 28, 29 and spaced side walls 30, 31 extend upwardly from the flange 26 with an interrupted upper or cover surface 32. The interruptions in the upper surface 32 are formed by apertures 33 of rectangular configuration which extend downwardly into the side walls 30, 31 and terminate in opposed arcuate walls 34, the side walls 30, 31 also being provided with three vertically disposed slots 35, 36, 37 which are in transverse alignment with one another.

Switch actuating members or levers 38, 39 formed of plastics material are positioned, respectively, in the apertures 33 and are pivotally mounted, in cantilever fashion, in the side walls 30, 31 by trunnion journals 40 located in the opposed slots 35 and 37. A leaf spring 41 forming the switch contact is positioned longitudinally in the casing 25 beneath the actuating members 38, 39 and is bent to form spaced humps or protuberances 42, 43 adjacent, respectively, the end walls 28, 29 of the casing, the distance between the forward end of the hump 42 and the rearward end of the hump 43 being greater than the distance between the spaced end walls 28, 29, which causes the spring 41 to flex for a purpose hereinafter described.

The center portion of the leaf spring contact 41 is positioned between a two-part pivot and guide member which comprises a platform 44, the sides of which are provided with aligned, centrally disposed recesses 45, and a pivot member 46 provided with opposed trunnion journals 47 accommodated, respectively, in the recesses 45. The two part member is pivotally mounted by means of the trunnions 47 which are located in the slots 36 formed in the casing 12.

Figure 3:
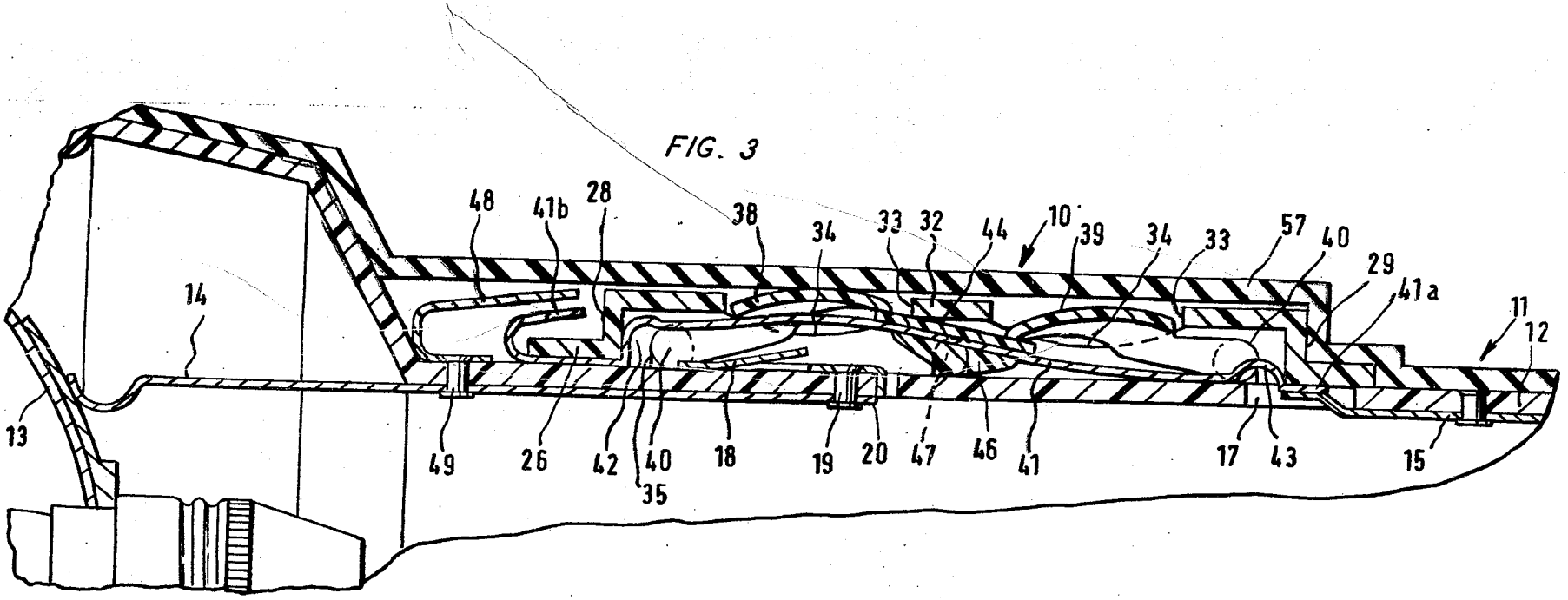
FIG. 3 is an enlarged sectional view of the switch portion of the flashlight of FIG. 1 depicting the switch in its "off" condition.
Figure 4:
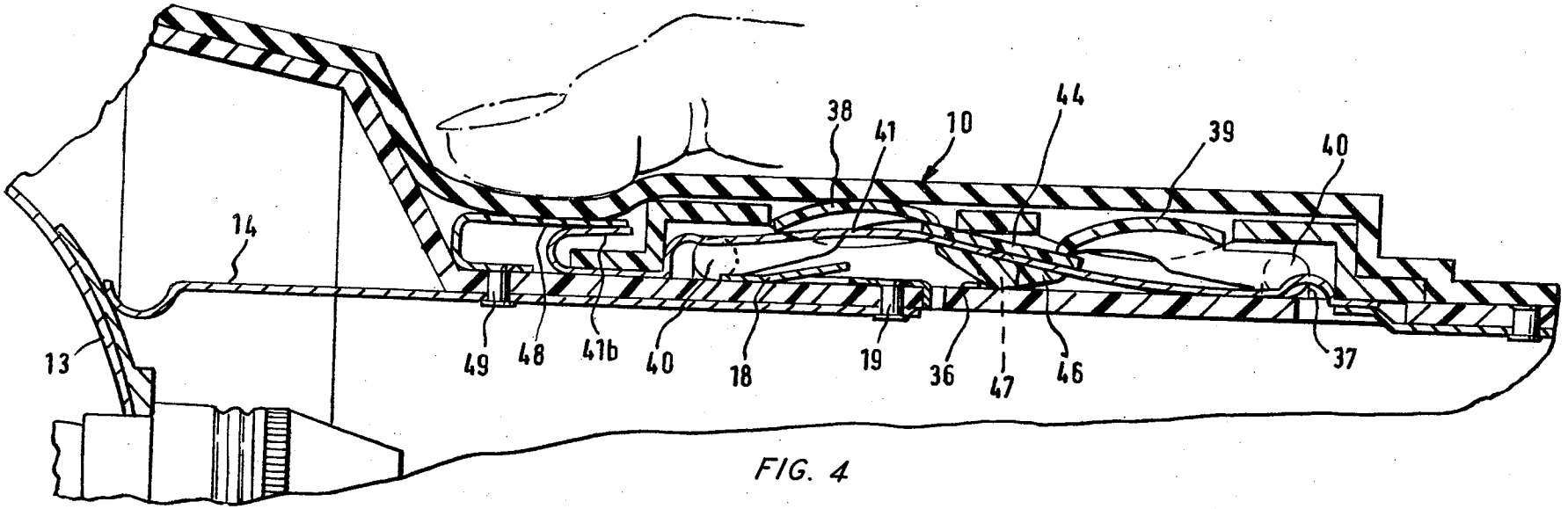
FIG. 4 is a view similar to FIG. 3 depicting the switch in its "flashing" condition.

With the switch casing fixedly mounted on the torch casing 12, the rearward extremity 41*a* of the spring contact 41 is connected at all times to the rear contact 21, while the forward portion of the spring 41 between the forward hump 42 and the two-part member 44, 46 may be in engagement with the contact 18 as shown in FIG. 1 which completes the electrical circuit to operate the flashlight, or deflected away from the contact 18 as hereinafter described to assume the position shown in FIG. 3 and disconnect the electrical circuit. The forward extremity 41*b* of the spring contact 41 extends beyond the front portion of the peripheral flange 26 and is bent upwardly and rearwardly beneath a "flasher" contact 48 which is fixedly connected to the casing 11 and reflector contact strip 14 by a rivet 49.

In operation, assuming the switch 10 is in the "on" position shown in FIG. 1, in order to move the switch to the "off" position, the actuating member or lever 39 is depressed so that it swings downwardly about its trunnion journals 40, pivoting the two-part member 44, 46 clockwise (as viewed in FIG. 1) about its trunnion journals 47. This movement moves the rearward or right-hand portion of the spring 41 downwardly and causes the forward or left-hand portion thereof to be flexed upwardly with a "snap" action so that it is moved away from the contact 18. When it is desired to move the switch to the "on" position, the actuating member or lever 38 is depressed and the above-described operation is repeated on the other side of the switch to bring the forward, or left-hand portion of the spring 41 in to engagement with the contact 18. Thus, it can be seen that alternate depression of the actuating members 38, 39 results in a "see-saw" action of the two-part member 44, 46.

The "flasher" contact 48 is used when the switch 10 is in the "off" position, i.e. the actuating member or lever 39 is depressed. If, under this condition, the contact 48 is depressed it engages the end 41*b* of the leaf spring contact 41 which completes the electrical circuit for flashing the flashlight. The resilience of the contact 48 breaks contact with the end 41*b* when pressure thereon is released.

As shown in FIG. 1 the plastics casing 12 is encased in a flexible water or moisture-proof casing 50 formed of rubber or synthetic resinous material. A rubber sleeve 51 surrounds and tightly grips a cap 52 which maintains the bulb and reflector assembly 13 correctly positioned in the torch and at its outer end, the sleeve 51 has an inwardly facing groove 53 in its inner wall which accommodates and grips an outer glass disc 54. In order to provide a water or moisture-proof seal between the disc 54 and the walls of the groove 53, a rubber sealing ring 55 is applied to the peripheral margin of the glass disc 54.

The open end of the flexible casing 50 is in the form of a cylindrical flange 56 which is normally folded back on itself and tightly grips the outer surface of the sleeve 51 to form a water or moisture proof joint therewith.

The flexible casing 50 is provided with an integral housing portion 57 accommodating the switch 10, the surface of the casing 50 adjacent the actuating members 38, 39 and flasher contact 48 indicating where pressure must be applied by the user to effect operation of the flashlight.

I claim:

1. A switch for an electrical appliance comprising a casing having spaced end and side walls, a leaf spring forming the switch contact strip, pivot means for said spring mounted on said casing and positioned intermediate the ends of the spring to form a first spring portion and a second spring portion, a first contact in continuous engagement with said strip, a second contact spaced from said first spring portion for engagement thereby, spaced protuberances on said spring which engage the inner surfaces of said casing end walls, the distance between said end walls being less than the distance between said protuberances which causes bowed flexure of said spring along said first and second portions, and actuating members comprising levers having pivots mounted within the casing in spaced relationship to said leaf spring pivot, said actuating members selectively flexing said first bowed spring portion from a switch closed position in engagement with said second fixed contact to a switch open position out of engagement therewith and vice-versa.

2. A switch as claimed in claim 1, including apertures formed in the casing side walls adjacent said end walls and wherein each actuating lever is provided with opposed trunnion journals mounted in said apertures.

3. A switch as claimed in claim 1, wherein said leaf spring pivot means comprises a platform and pivot member provided with opposed trunnion journals located, respectively, in apertures formed in the casing side walls, said levers engaging the opposite ends of said platform, respectively.

4. A switch as claimed in claim 3, wherein the casing, actuating members and platform and pivot member are formed from plastics material.

5. An electric flashlight comprising a first circuit contact, a second circuit contact spaced from said first contact, a switch for selectively connecting and disconnecting said first and second circuit contacts, said switch including a casing having spaced end and side walls, a leaf spring forming the switch contact strip pivoted intermediate its ends on said casing to form a first spring portion movable into and out of engagement with said first circuit contact and a second spring portion in permanent engagement with said second circuit contact, spaced protuberances on said spring which engage the inner surfaces of said casing end walls, the distance between said end walls being less than the distance between said protuberances which causes flexture of said spring, and nonlatching actuating members operative on said spring to selectively effect said movement of the first spring portion into and out of engagement with said first circuit contact.

6. A flashlight as claimed in claim 5, wherein the end of the leaf spring positioned adjacent said first portion extends beyond the casing, a "flasher" contact electrically connected to said first contact and adapted to engage said extending end to operate the flashlight when said first spring portion and second contact are disconnected.

7. A flashlight as claimed in claim 5, having a casing formed of rigid plastics material.

8. A flashlight as claimed in claim 7, having a flexible water or moisture-proof casing formed of elastomeric material covering said casing formed of rigid plastics material.

* * * * *